US008674890B2

(12) United States Patent
Bit-Babik et al.

(10) Patent No.: US 8,674,890 B2
(45) Date of Patent: Mar. 18, 2014

(54) WIDEBAND AND MULTIBAND EXTERNAL ANTENNA FOR PORTABLE TRANSMITTERS

(75) Inventors: Giorgi Bit-Babik, Sunrise, FL (US); Antonio Faraone, Fort Lauderdale, FL (US)

(73) Assignee: Motorola Solutions, Inc., Schaumburg, IL (US)

( * ) Notice: Subject to any disclaimer, the term of this patent is extended or adjusted under 35 U.S.C. 154(b) by 772 days.

(21) Appl. No.: 12/771,420

(22) Filed: Apr. 30, 2010

(65) Prior Publication Data

US 2011/0267253 A1 Nov. 3, 2011

(51) Int. Cl.
*H01Q 5/01* (2006.01)
*H01Q 9/40* (2006.01)

(52) U.S. Cl.
USPC ..... 343/749; 343/828; 343/862; 343/895

(58) Field of Classification Search
USPC ..... 343/722, 749, 895, 745, 750, 861, 790, 343/828, 862
See application file for complete search history.

(56) References Cited

U.S. PATENT DOCUMENTS 4,080,604 A * 3/1978 Wosniewski ..... 343/750
4,117,493 A * 9/1978 Altmayer ..... 343/750
5,374,937 A * 12/1994 Tsunekawa et al. ..... 343/702
5,844,525 A * 12/1998 Hayes et al. ..... 343/702
5,923,305 A 7/1999 Sadler et al.
6,054,958 A 4/2000 Holshouser et al.
6,100,848 A * 8/2000 Hayes ..... 343/702
6,107,970 A * 8/2000 Holshouser et al. ..... 343/702
6,288,681 B1 9/2001 Kim et al.
2004/0189535 A1 9/2004 Kim

OTHER PUBLICATIONS

PCT International Search Report Dated Sep. 29, 2011 for Counterpart Application.
Flexible Whip Antenna Description; Motorola, Inc., Nov. 4, 2009.
PCT International Search Report and Written Opinion for Counterpart Application PCT/US2011/031057.

* cited by examiner

*Primary Examiner* — Michael C Wimer
(74) *Attorney, Agent, or Firm* — Daniel R. Bestor; Anthony P. Curtis

(57) ABSTRACT

A communication device is presented that has an antenna structure with a relatively short length and covers multiple resonances including the UHF and the GPS bands. The antenna structure has a conductive base to which a whip antenna is connected through a helical radiating element. A cylindrical sheath capacitively connected to the helical element provides distributed impedance matching for the antenna structure. A monopole or another helical element provides higher resonance than that of the whip antenna or connected helical element. If the higher resonance is provided by a monopole, the monopole is disposed radially adjacent to the helical element and is capacitively connected with the helical element through an opening in the sheath. If the higher resonance is provided by a helical element, the helical element is capacitively or galvanically connected to the end of the whip antenna.

14 Claims, 10 Drawing Sheets

WIDEBAND AND MULTIBAND EXTERNAL ANTENNA FOR PORTABLE TRANSMITTERS

TECHNICAL FIELD

The present application relates generally to a communication device and in particular to a communication device containing a multi/broadband antenna of reduced size.

BACKGROUND

With the continued and ever-increasing demand for portable communication devices coupled with the advance of various technologies, it has been desirable to provide the ability of portable communication devices to communication in different frequency bands. The ability to use multiple frequency bands has many advantages, for example, permitting communications in different locations around the world in which one or more of the different bands are used, providing a backup so that the same information can be provided through the different bands, or permitting different information to be provided to the device using the different frequencies and permitting the device to determine the manner in which to respond to the different information.

Although a system of separate antennas may be employed in which the individual antennas are electronically and/or mechanically switched in and out of operation as desired, such a system has multiple problems: it is expensive, requires complex algorithms to effectuate the switching, consumes a substantial amount of power to switch from one antenna to another, can generally only handle low power transmissions, and introduces a significant amount of distortion causing out of band energy spreading over many spurious frequencies. It is thus desirable to limit the number of separate antennas to a single combined passive structure that functions in the multiple bands. One particularly useful combination of bands includes ultra high frequency (UHF) band (about 380-540 MHz and 770-870 MHz) and the Global Positioning Satellite (GPS) band (about 1.575 GHz). This combination is particularly desirable for public safety providers (e.g., police, fire department, emergency medical responders, and military) who have traditionally used the UHF band maintained exclusively for public safety purposes. With the advent of GPS, it has become desirable to be able to determine locations of the public safety providers to better manage increasingly scarce resources, coordinate quicker response, and guide personnel safely through potentially dangerous situations.

It is especially challenging however to combine individual antennas with these bandwidths into a single structure. Although it is desirable to provide an antenna structure with minimized physical dimensions while maximizing signal response, designing antenna structures with these features becomes increasingly more difficult as the number of bands to be covered increases. For example, current high-performance dual-band antenna structures have an increased length or have a substantially larger diameter so that the antenna structure is not mechanically flexible enough to meet mechanical (drop or bend) tests designed to ensure the reliability of the radio. Additionally, the length and/or diameter of current dual band antenna structures are sufficiently large that users, especially those who were used to relatively small single-band antenna structures, find the communication device so unwieldy (the length and thickness as well as inflexibility) that the antenna structure is often one significant sources of customer complaints. For example, when radios having current multi-band antennas are attached to the shoulder of public safety personnel (allowing the personnel e.g. to hear audio adequately in high-noise environments, e.g., a fire scene), the length of the multi-band antennas is substantial enough to interfere with movement in the direction of antenna placement, especially when equipment such as smoke masks are being used.

Accordingly, it is desirable to provide a combined antenna structure that has sufficient performance while retaining a relatively small form factor.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
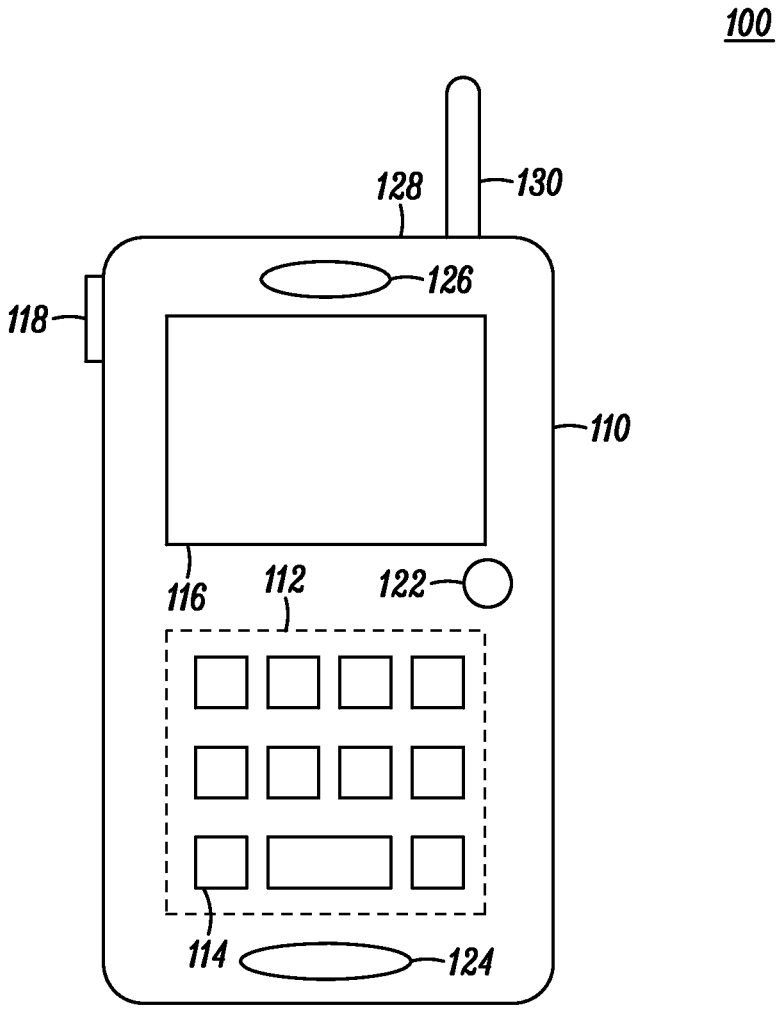
FIG. 1 illustrates one embodiment of a communication device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of the embodiments of shown.

The apparatus and method components have been represented where appropriate by conventional symbols in the drawings, showing only those specific details that are pertinent to understanding the embodiments shown so as not to obscure the disclosure with details that will be readily apparent to those of ordinary skill in the art having the benefit of the description herein. Other elements, such as those known to one of skill in the art, may thus be present.

DETAILED DESCRIPTION

Before describing in detail the various embodiments, it should be observed that such embodiments reside primarily in combinations of apparatus components related to a multi-band (at least tri-band) antenna structure that is relatively thin and short (e.g., about ¼ or ⅕ of the wavelength of the lowest operating frequency or 150 mm in various embodiments). The antenna structure contains a first radiating element galvanically connected with a feed point and another radiating element capacitively or galvanically connected to the first radiating element. The other radiating element has a resonance that varies from above the resonance of the first radiating element to GPS or 2.5 GHz or even higher if desired. The first radiating element is also galvanically connected to an impedance matching element.

In one embodiment, the first radiating element is a monopole attached to a feed point via a base coil. The antenna feed point is elevated above the radio top face using an extruded coaxial feed line. A cylindrical conductive sheath (either open or closed) around the monopole and the coaxial shield extrusion provides, in conjunction with the base coil, distributed impedance matching for the antenna structure. The sheath provides a capacitive path to ground from the base coil to the coaxial shield. The combination of the sheath, base coil and shield form the impedance matching element.

One embodiment of a portable communication device is shown in FIG. 1. The communication device 100 has a body 110 to which the antenna structure 130 is connected via known means such as screwing in the antenna structure 130 to a tapped receiving structure (not shown) in the body 110. The tapped receiving structure typically resides in the top face 128 of the radio. The antenna structure 130 provides multiband transmission and reception. The body 110 contains internal communication components and circuitry as further described with relation to FIG. 2 to enable the device 100 to communicate wirelessly with other devices using the antenna structure 130. The body 110 also contains I/O devices such as a keyboard 112 with alpha-numeric keys 114, a display 116 (e.g., LED, OELD) that displays information about the device 100, a PTT button to transmit 118, a channel selector knob 122 to select a particular frequency for transmission/reception, soft and/or hard keys, touch screen, jog wheel, a microphone 124, and a speaker 126. The channel selector knob 122 and/or keyboard 112, for example, may be used to select the operating band/channel of the antenna structure 130. Not all of the I/O devices shown in FIG. 1 may, of course, be present depending on the particular communication device 100 in which the antenna structure 130 is being employed.

Figure 2:
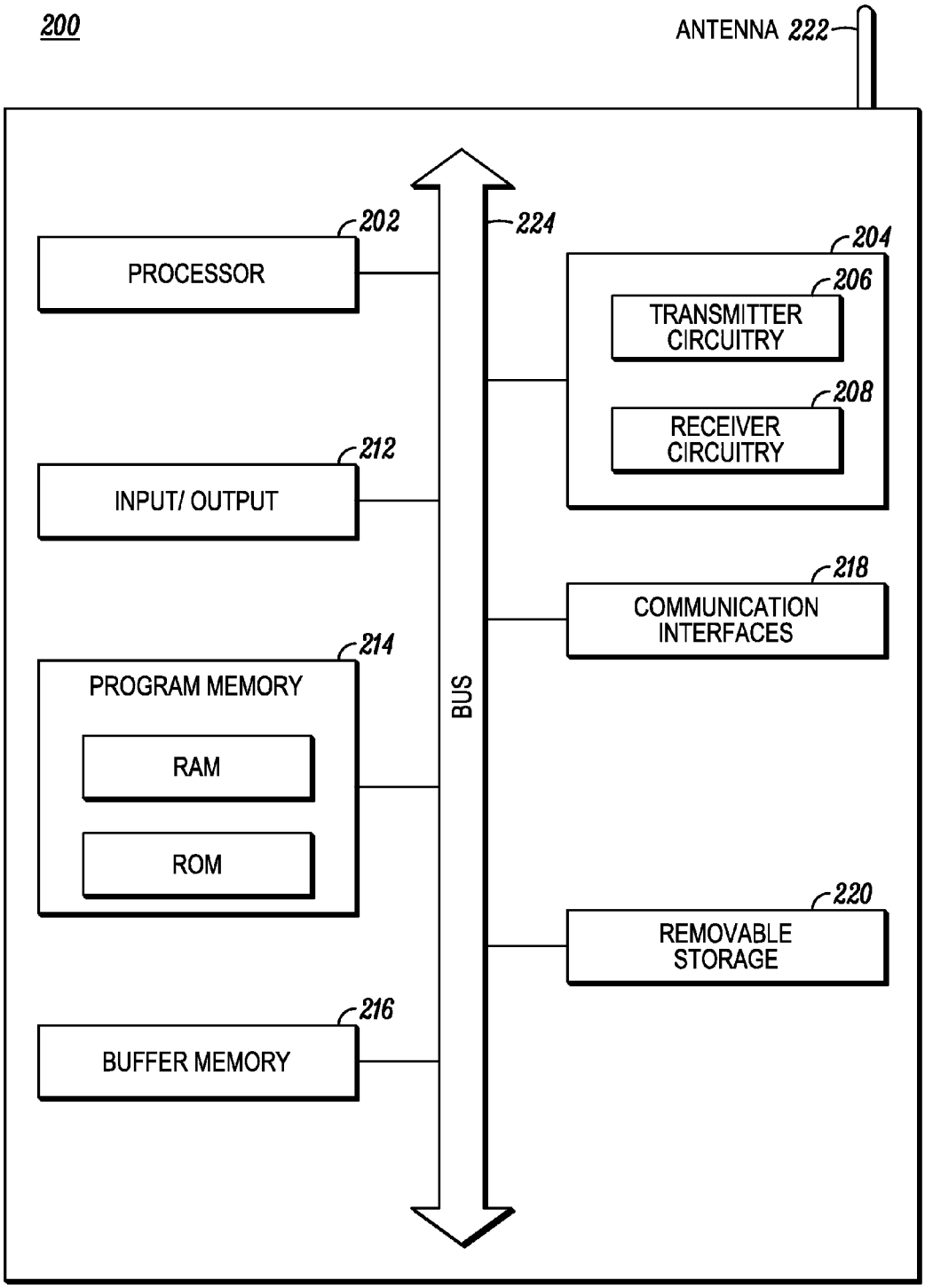
FIG. 2 illustrates an internal block diagram of an embodiment of a communication device.

Turning to the electronics within the communication device, one embodiment is shown in the block diagram of FIG. 2. The communication device 200 contains, among other components, a processor 202, a transceiver 204 including transmitter circuitry 206 and receiver circuitry 208, an antenna 222, the I/O devices 212 described in relation to FIG. 1, a program memory 214 for storing operating instructions (such as estimation and correction of a received signal and encryption/decryption) that are executed by the processor 202, a buffer memory 216, one or more communication interfaces 218, and a removable storage 220. The communication device 200 is preferably an integrated unit containing at least all the elements depicted in FIG. 2, as well as any other element necessary for the communication device 200 to perform its electronic functions. The electronic elements are connected by a bus 224.

The processor 202 includes one or more microprocessors, microcontrollers, DSPs, state machines, logic circuitry, or any other device or devices that process information based on operational or programming instructions. Such operational or programming instructions are preferably stored in the program memory 214. The program memory 214 may be an IC memory chip containing any form of random access memory (RAM) or read only memory (ROM), a floppy disk, a compact disk (CD) ROM, a hard disk drive, a digital video disk (DVD), a flash memory card or any other medium for storing digital information. One of ordinary skill in the art will recognize that when the processor 202 has one or more of its functions performed by a state machine or logic circuitry, the program memory 214 containing the corresponding operational instructions may be embedded within the state machine or logic circuitry. The operations performed by the processor 202 and the rest of the communication device 200 are described in detail below.

The transmitter circuitry 206 and the receiver circuitry 208 enable the communication device 200 to respectively transmit and receive communication signals. In this regard, the transmitter circuitry 206 and the receiver circuitry 208 include appropriate circuitry to enable wireless transmissions. The implementations of the transmitter circuitry 206 and the receiver circuitry 208 depend on the implementation of the communication device 200 and the devices with which it is to communicate. For example, the transmitter and receiver circuitry 206, 208 may be implemented as part of the communication device hardware and software architecture in accordance with known techniques. One of ordinary skill in the art will recognize that most, if not all, of the functions of the transmitter or receiver circuitry 206, 208 may be implemented in a processor, such as the processor 202. However, the processor 202, the transmitter circuitry 206, and the receiver circuitry 208 have been artificially partitioned herein to facilitate a better understanding. The buffer memory 216 may be any form of volatile memory, such as RAM, and is used for temporarily storing received information.

Figures 3A, 3B, 3C, 3D:
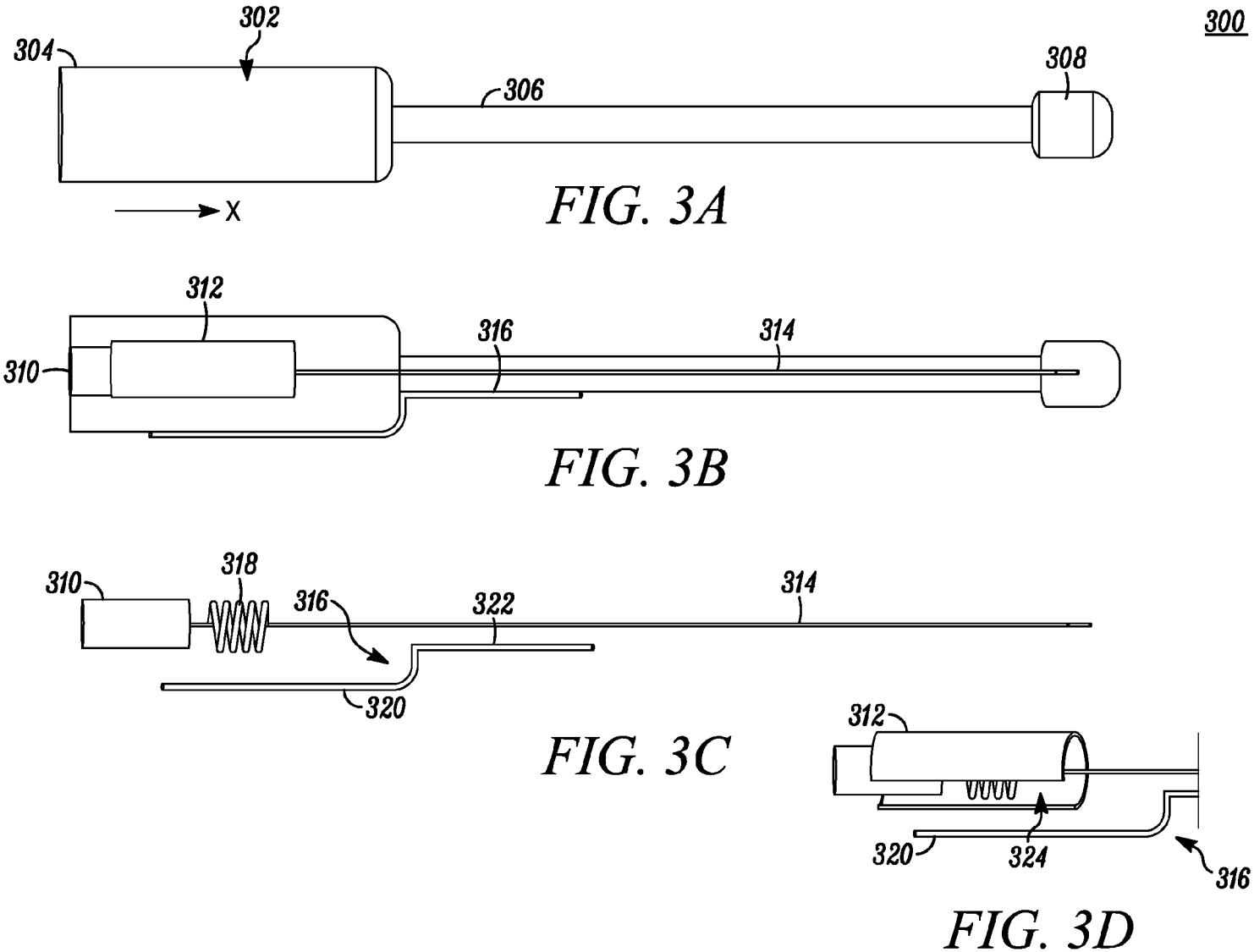
FIGS. 3A-3D show various diagrams of an embodiment of an antenna structure.

One embodiment of various layers of an entirely passive antenna structure is shown in FIGS. 3A-3D. As illustrated in FIG. 3A, the antenna structure 300 is formed from three portions: a base portion 304, a middle portion 306 and a terminal portion 308. Each section contains a portion of a cover 302, which surrounds radiating elements disposed therein. The cover 302 is usually formed of molded plastic or some other similar material. As multiple radiating elements are disposed at the base portion 304, the base portion 304 (and consequently the cover 302 at the base portion 304) is thicker (i.e., has a larger diameter than) than the middle portion 306 or terminal portion 308. The base portion 304 extends for a substantial amount of the antenna structure 300. Although this is shown in FIG. 1 as about a quarter of the antenna structure 300, the actual proportions may vary. The terminal portion 308 may be thicker than the middle portion 306 in some embodiments. This arrangement permits multiple radiating elements to be positioned in the base portion 304 and provides space for an additional element to be disposed in the terminal portion 308 while permitting the middle portion 306 to retain a relatively small diameter, thereby increasing flexibility of the antenna structure 300. Although the base portion 304 is shown as being substantially cylindrical, in other embodiments it may be tapered so as to be conical.

Within the cover 302 are a coaxial shield 310 and a conductive sheath 312 as well as radiating elements 314, 316 as shown in FIGS. 3B and 3C. The first radiating element 314 is a wire monopole (also called a whip antenna) that extends along a majority of the length of the antenna structure 300 (as shown substantially the entire length of the antenna structure 300) from the end of a base coil 318 in approximately the center of the antenna structure 300 and in parallel with the length of the antenna structure 300. In FIG. 3 (and the other figures illustrating various embodiments of the antenna structure), the direction of the length of the antenna structure is defined by the direction shown by x.

The second radiating element 316 is a parasitic dipole that extends through substantially about half of the length of the cover 302. In one embodiment, the second radiating element 316 extends from the base portion 304 farther than the length of the base portion 304 and curves inward with the cover 302 as the cover 302 transitions from the base portion 304 to the middle portion 306. In other embodiments, the second radiating element may, like the first radiating element 314, also be a straight wire monopole.

The first radiating element 314 is connected to a feed through the base coil 318. The feed is the inner conductor (not shown) within the coaxial shield 310. The coaxial shield 310 and its inner conductor form a raised coaxial feed. The first radiating element 314 and the base coil 318 may be formed from a single wire or may be formed from different galvanically connected pieces of conductive material.

The base coil 318 is helical and is disposed within the sheath 312. The sheath 312 overlaps both the base coil 318 and coaxial shield 310 and thus is capacitively coupled with the base coil 318 and the coaxial shield 310. As illustrated in the embodiment shown in FIG. 3D, the sheath 312 is a semi open metal section with an opening 324 that exposes the base coil 318 to a first parasitic section 320 of the second radiating element 316. The second radiating element 316 is disposed radially proximate enough to the coaxial shield 310 and the base coil 318 so that the base coil 318 and the second radiating element 316 are also capacitively coupled. The combination of the coaxial shield 310, the sheath 312 and the base coil 318 forms an impedance matching element.

A second parasitic section 322 of the second radiating element 316 is similarly sufficiently proximate radially to the first radiating element 314 such that the first radiating element 314 and the second radiating element 316 are electromagnetically coupled. The second radiating element 316 is electrically floating, i.e., it is not in galvanic contact with either the feed point or ground. The second radiating element 316 may be formed from a wire, metallic tape or other conductive material. Similarly, the sheath 312 may be formed from a single metal piece, a plated structure, or a piece of foil.

The antenna structure 300 of FIG. 3 adds additional flexibility to optimize for a targeted performance without affecting substantially either the complexity or cost of the antenna structure 300 unlike other antennas providing similar coverage. The overall structure of the antenna structure 300 also does not significantly differ in dimensions and shape from current single-band antennas operating in the 700-800 MHz band. For example, some current public safety communication devices have a single band antenna of about 177 mm and dual band antenna of about 210 mm (an increase in length of about 20%), whereas the current design provides a multiband antenna having essentially the same efficiency in the bandwidth range of a single band antenna but having a length of only about 125-135 mm, about 30% less than the single band antenna and about 40% less than currently used dual band antennas. As indicated above, some of the existing dual band antennas are relatively thick and inflexible, having a diameter of about 11 mm, making these antennas less desirable to emergency service providers. The physical limit to minimization of the antenna structure depends on the longest wavelength range to be covered. To be an effective radiator, the radiating elements have electrical lengths of $\lambda/4$. Thus, a UHF radiating element has a relatively long electrical length of $\lambda/4$ at the lower edge of the UHF band, or about 19 cm, while a GPS radiating element has a length of $\lambda/4$, or about 4.5 cm. Effective radiators can also be formed having electrical lengths of about $\lambda/5$, although this increases the design limitations and thus sacrifices increasing complexity for reduced antenna length. Other design complexities, such as gain maximization and antenna coupling also exist: for example, unlike the UHF radiating element whose peak gain is directed essentially horizontally towards the base station or other portable communication devices, the peak gain of the ideal GPS radiating element is directed upward (away from feed point or the base of the radiating element) toward the GPS satellites.

Figure 4:
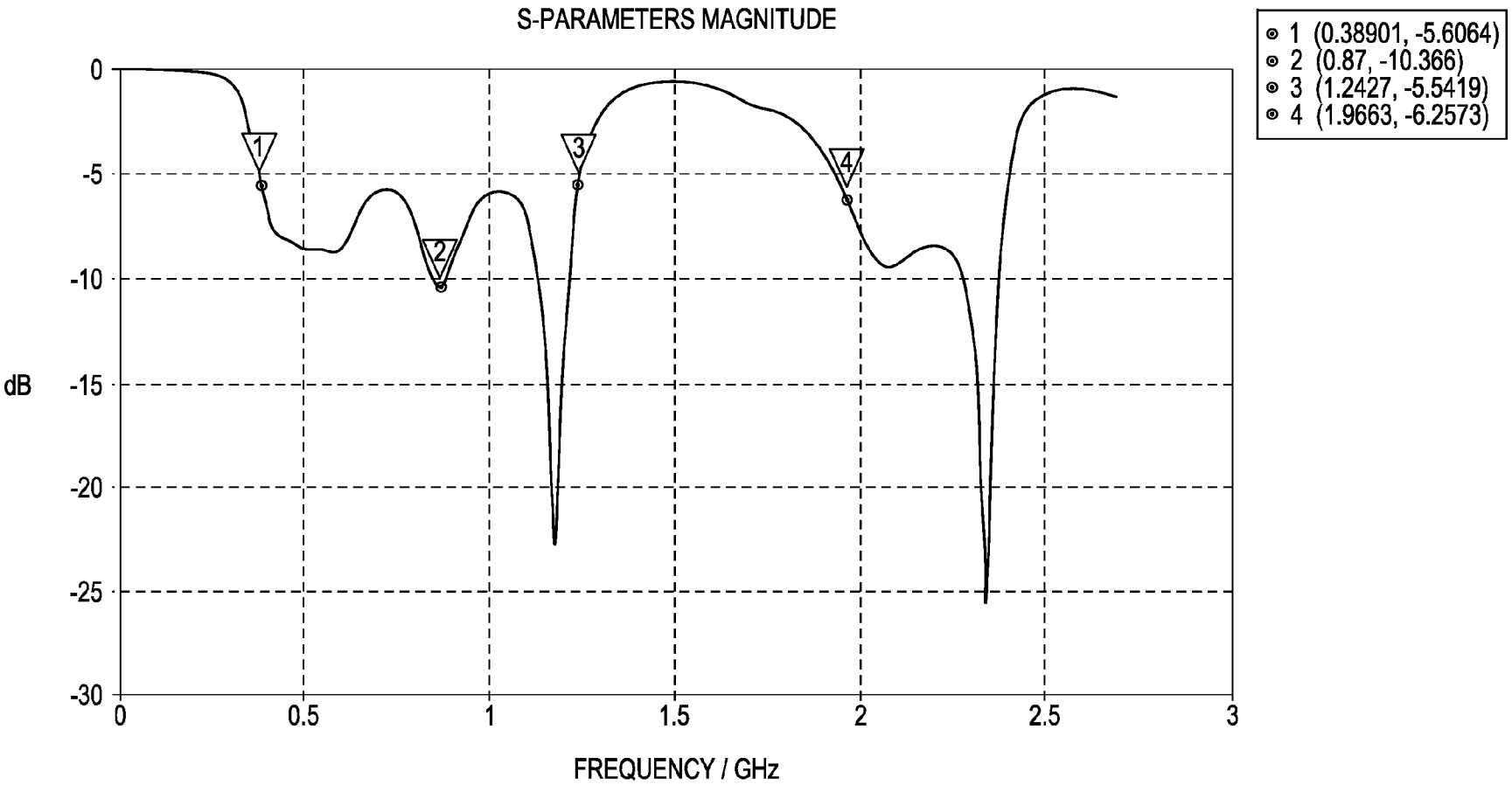
FIG. 4 is an S-parameter simulation of one embodiment of the antenna structure shown in FIGS. 3A-3D.
Figure 5:
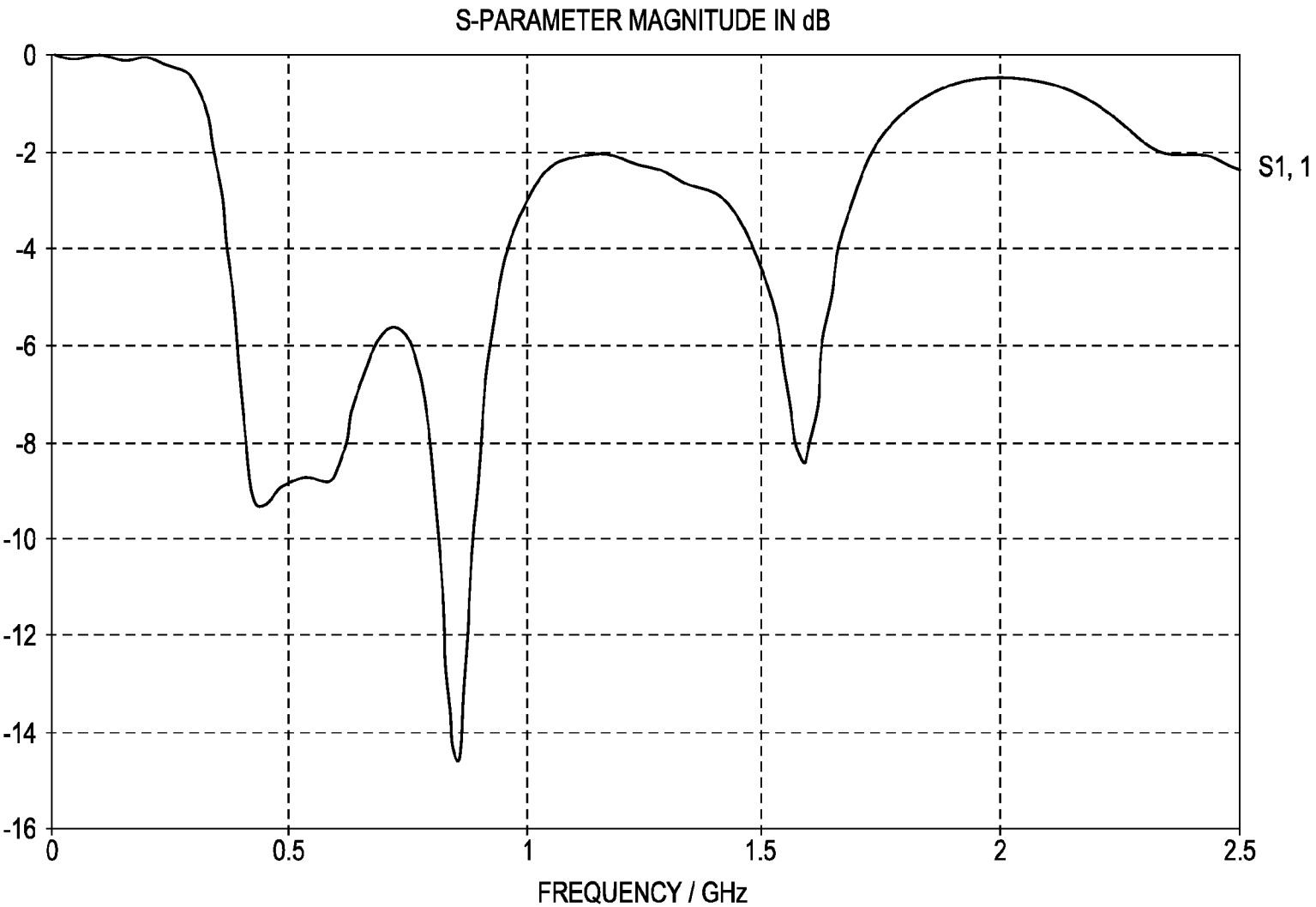
FIG. 5 is an S-parameter simulation of another embodiment of the antenna structure shown in FIGS. 3A-3D.

FIGS. 4 and 5 show simulations of S-parameter responses for different antenna structures in which an $S_{11}$ parameter of about −6 dB or lower is considered to provide adequate response (better than about 75% delivered power to the antenna). Specifically, FIG. 4 shows the response of an antenna providing continuous coverage from the lower end of the UHF band (about 380 MHz) up to about 1.2 GHz with an additional band of about 2 to 2.5 GHz. The continuous coverage is thus over 120% of the bandwidth and may be employed in public safety applications to cover the full the UHF and Public Safety bands as well as all cellular bands or GPS military band L2 (1227.60 MHz) to comply with portable radio requirements. This antenna structure may be used in Software Defined Radio (SDR) applications as it also covers TV white space as well as the 700 MHz LTE bands. FIG. 5 shows the response of a tri-band antenna covering the UHF band (about 450 MHz-600 MHz), the Public Safety band (about 700-800 MHz) and the GPS band (about 1.575 GHz). The peak responses shown in the S-parameter responses of the figures are also known as resonant modes. The GPS radiating element in these figures is a half-wave element.

As is apparent from FIGS. 3A-3D, there are many interrelated design parameters that are adjusted to effectuate the antenna response. In addition to the geometries of the different radiating elements (e.g., lengths of the first and second radiating elements, the number of coil turns as well as their relative proximity in the base coil), the size and shape (and presence) of the opening in the sheath, the amount of overlap between the conductive sheath and each of coaxial shield and base coil (which provides shunt capacitance for impedance matching) as well as the proximity to each of the coaxial shield and base coil, the location of the parasitic second radiating element along the length of the antenna and its distance from the first radiating element, the base coil and the sheath, and the materials used in the antenna structure (which may have different dielectric constants and loss factors) are also design parameters to consider. The overall antenna length and the distributed matching arrangement control the response at the lower operating frequency band while changes in the parasitic element length/location allow independent tuning of the additional operating bands. The helical base coil and the capacitively-coupled second radiating element synthesize the antenna input impedance to match that of a typical 50 Ohm source with acceptable return loss levels.

As shown in FIGS. 4 and 5, using certain combinations of the parameters it is possible to provide either multiband coverage or achieve over 120% continuous fractional bandwidth starting at low operating frequency. The combination of the different components within the antenna and the specific relationship between their parameters provides enhanced flexibility in design to target different multiband coverage requirements. Because the antenna geometry is entirely passive and the impedance matching is distributed at the antenna base, the use of a separate integrated matching network can be avoided, thereby reducing antenna cost, complexity and size.

Figure 6:
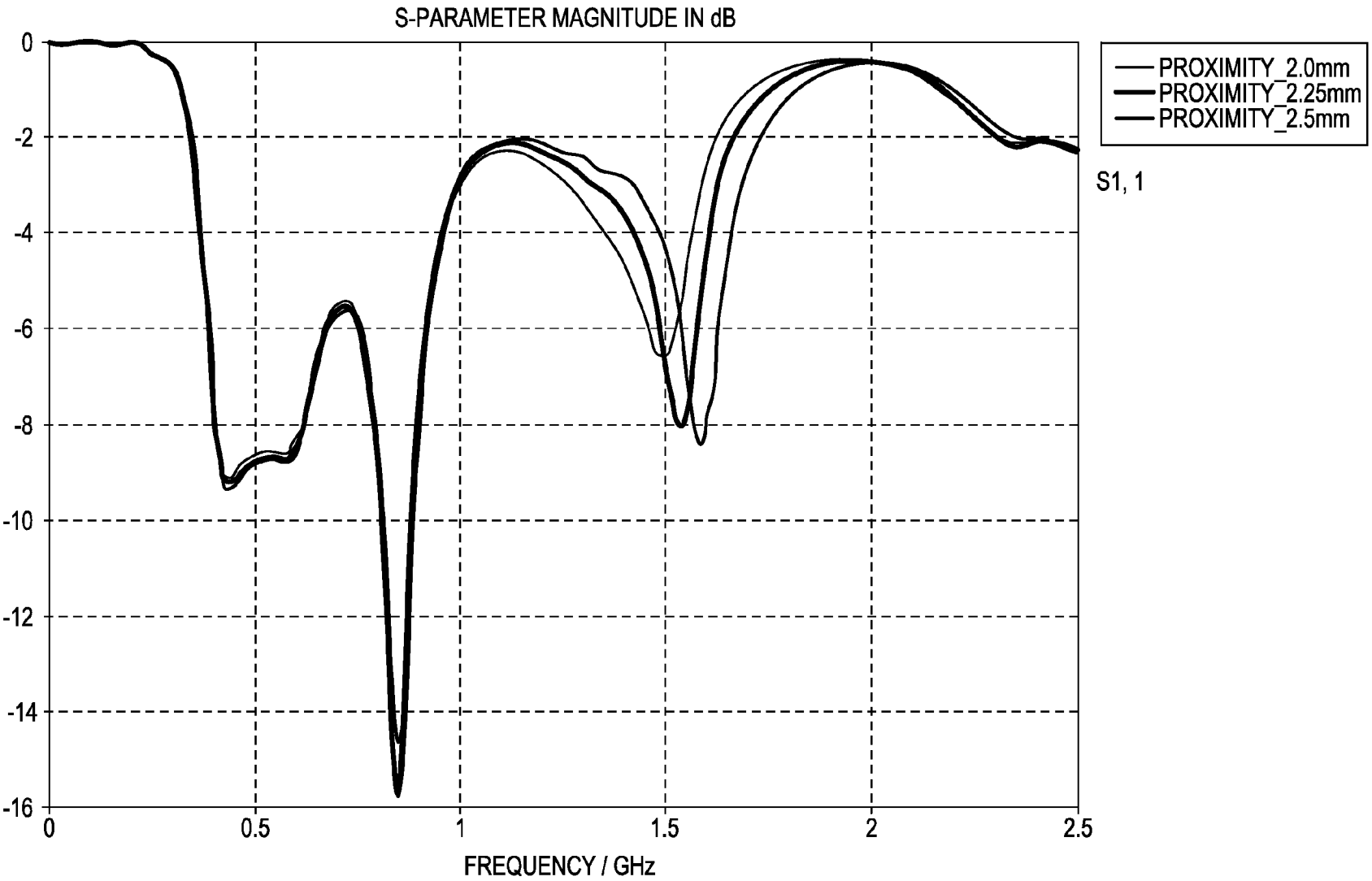
FIG. 6 is an S-parameter simulation of embodiments of the antenna structure shown in FIGS. 3A-3D varying the proximity of the capacitively connected radiating element with the helical radiating element.
Figure 7:
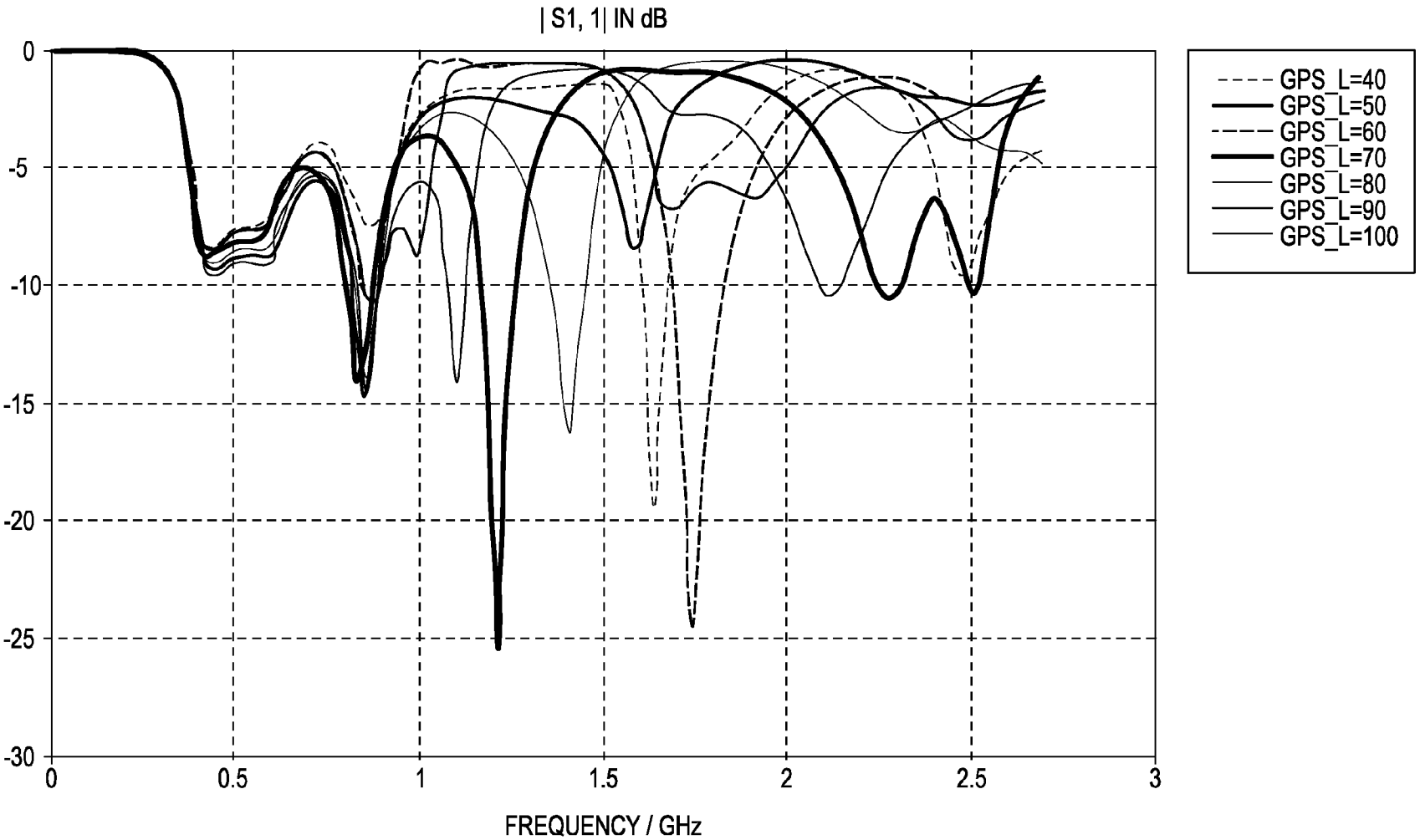
FIG. 7 is an S-parameter simulation of embodiments of the antenna structure shown in FIGS. 3A-3D varying the length of the capacitively connected radiating element.

FIG. 6 shows simulations of S-parameter responses for a tri-band antenna covering the UHF, 700-800 MHz and GPS bands (similar to FIG. 5) in which the effect of proximity variation between the floating second radiating element and the main monopole first radiating element was varied. As the distance between the floating second radiating element and the main monopole first radiating element was increased 25% from 2 mm to 2.5 mm, it was observed that the peak at around 1.5 GHz shifted by about 7% to about 1.6 GHz while the return loss did not degrade. The sensitivity of the frequency to the relative positioning was thus determined to be about 200 MHz/mm. Similarly, the length of the floating second radiating element was varied in simulations of S-parameter responses shown in FIG. 7. As seen, as the length changes by 10 mm, the frequency response of the upper band varies widely and is essentially able to be tuned independent of the response of the first radiating element. Simulated radiated efficiencies >95% (not including mismatch losses), with the GPS efficiency and azimuth gain comparable to that of current single and dual-band antennas. Simulations also show comparable two- and three-dimensional radiation patterns.

Figure 8:
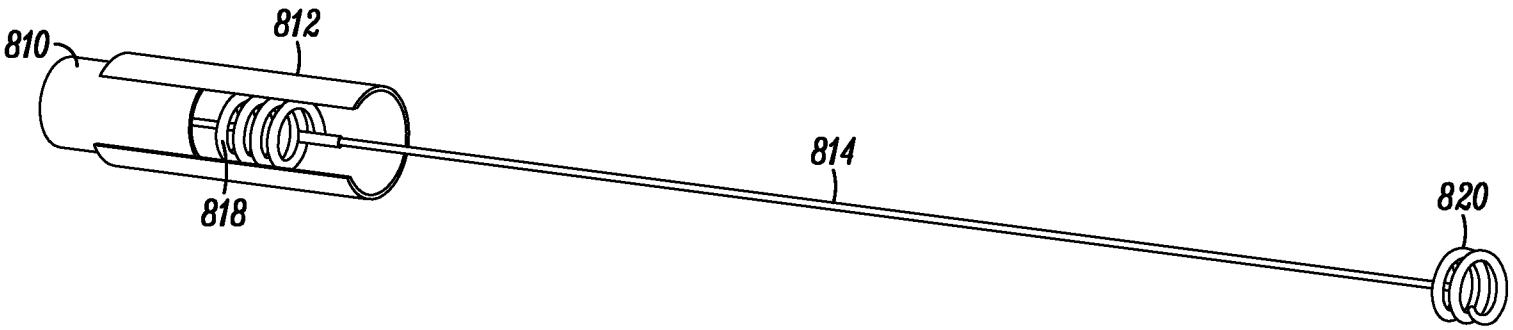
FIG. 8 shows a diagram of an embodiment of an antenna structure.

Another embodiment of a multi-band antenna is shown in FIG. 8. The cover of the antenna structure 800 is not shown for convenience. The antenna structure 800 is similar to the antenna structure of FIG. 3 in that the monopole first radiating element 814 is connected to the raised coaxial feed 810 through the helical base coil 818. The raised coaxial feed 810 comprises an inner conductor (not shown) guiding the RF signal through the coaxial structure. The inner conductor is galvanically connected to the base coil 818. The second radiating element 820 of the antenna structure 800, however, is no longer a floating radiating element that is disposed radially adjacent to the base coil 818 as in the previously shown embodiment. Instead, the second radiating element 820 is another helical element disposed at the terminal portion of the antenna structure 800 most distal to the body of the communication device. The second radiating element 820 may be connected galvanically or capacitively to the first radiating element 814. The number of coils of the second radiating element 820 as well as their dimensions may be varied to provide a particular desired response.

Figure 9:
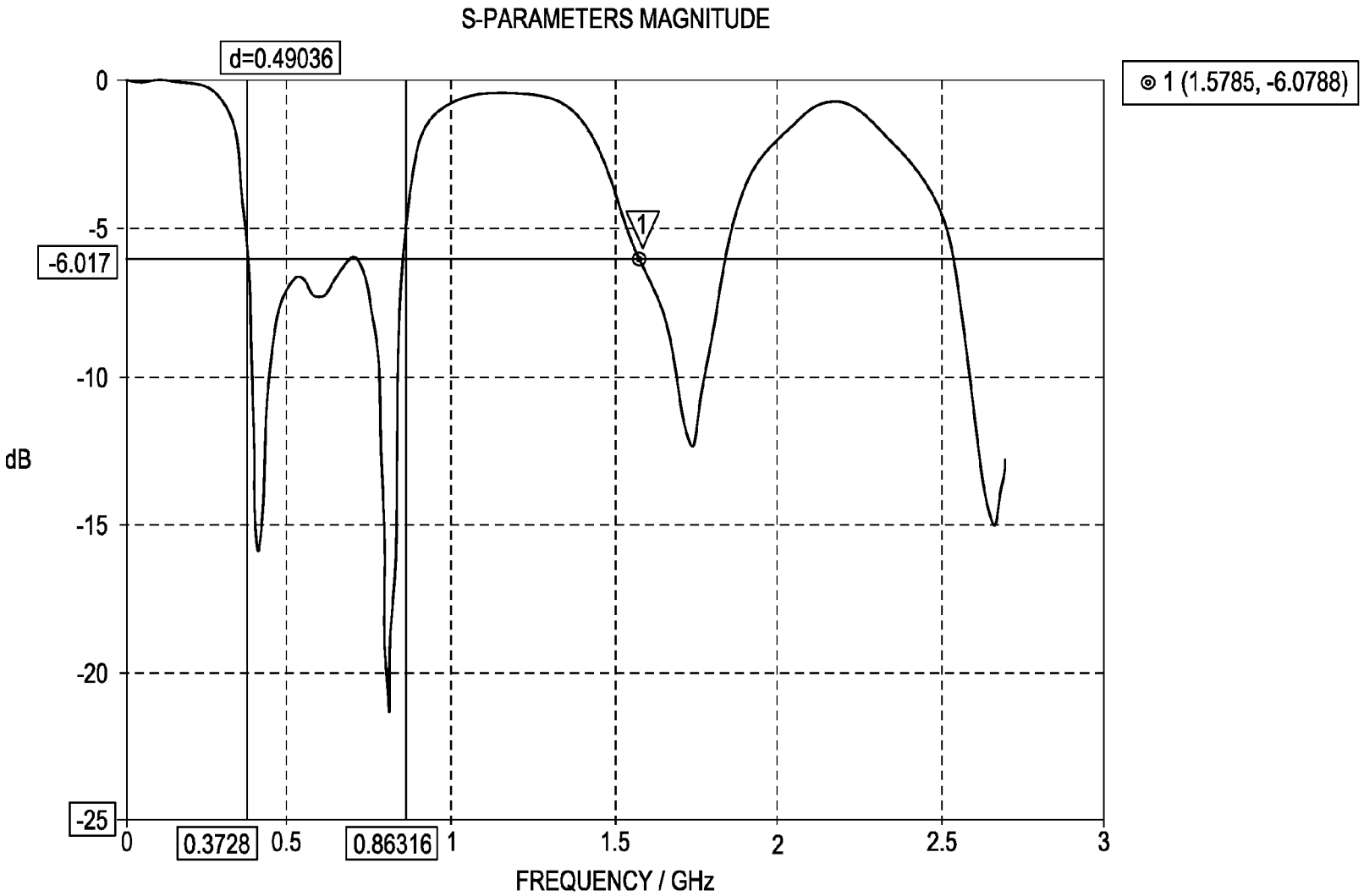
FIG. 9 is an S-parameter simulation of one embodiment of the antenna structure shown in FIG. 8.

Although the second radiating element 820 and the base coil 818 may appear to be similar, they perform separate functions whereby the second radiating element 820 emits RF energy while the base coil 818 mainly serves to provide distributed impedance matching. The sheath 812 surrounds the base coil 818 and extends around the raised coaxial feed 810 to provide the shunt capacitance for the distributed impedance matching. As in the previous embodiment, the impedance matching is provided by the series inductance provided by the base coil 818 and the shunt capacitance between the raised coaxial feed 810 and the sheath 812. The degrees of freedom in the design enable impedance matching from the UHF R1 and R2 bands (380-470 and 470 MHz-520 MHz) all the way up to about 900 MHz. This permits the simulated frequency response shown in FIG. 9 to be achieved (about 370-865 MHz). As indicated above, this is a continuous band that encompasses TV white space as well as the 700 MHz LTE bands and 700-800 MHz Public Safety bands. A usable impedance response is also achievable at higher bands such as the GPS band while desirable radiation pattern characteristics are maintained, as above providing the desired azimuth gain at UHF and 700-800 MHz and efficiency at GPS. Unlike the antenna structure shown in FIG. 3, however, as the second radiating element 820 does not couple capacitively to the base coil 818, the sheath may or may not have an opening. The latter case is referred to as a closed sheath.

Figure 10:
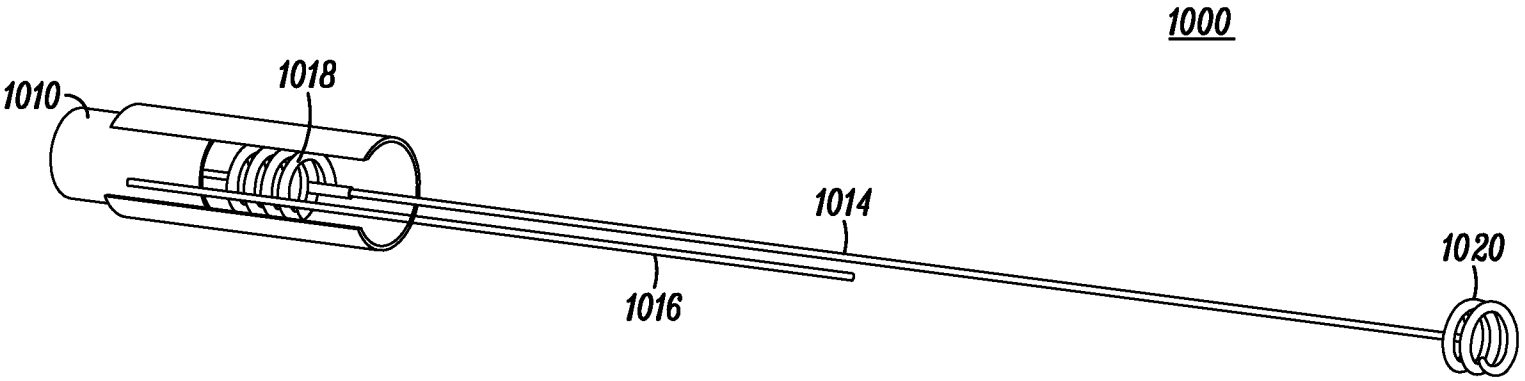
FIG. 10 shows a diagram of an embodiment of an antenna structure.

A further embodiment of a multi-band antenna is shown in FIG. 10. The antenna structure 1000 is similar to the antenna structure of FIG. 8 in that the monopole first radiating element 1014 is connected to the raised coaxial feed 1010 through the helical base coil 1018. A second radiating element 1016 is a floating radiating element that is disposed radially adjacent to the base coil 1018 and a third radiating element 1020 is another helical element disposed at the terminal portion of the antenna structure 1000. The third radiating element 1020 may be connected galvanically or capacitively to the first radiating element 1014.

The second radiating element 1016 is similar to the second radiating element 316 shown in FIGS. 3B-D and the third radiating element 1020 is similar to the second radiating element 820 shown in FIG. 8. The number of coil turns of the third radiating element 1020 as well as their dimensions may be varied to provide the desired response. Similar to the embodiment shown in FIG. 8, the third radiating element 1020 essentially functions to emit RF energy while the base coil 1018 primarily provides distributed impedance matching instead of emitting RF energy. This design may permit the second radiating element 1016 to be used to expand the lower range of the antenna response, provide additional gain or bandwidth at the GPS bands, or provide additional band coverage at about 2 to 2.5 GHz or even higher frequencies.

The various embodiments described herein provide antenna structures that are able to cover multiple frequency bands (UHF/700-800 MHz/GPS) using a smaller and more flexible structure. The length of the antenna structure is less than about 150 mm, and in the embodiments shown is approximately 130 mm (i.e., about 120-150 mm) At these lengths, the length of the antenna structure does not interfere with public safety provider equipment. The antenna structure has a simpler mechanical design and lower fabrication cost than other multiband antennas.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure and Summary section are provided to allow the reader to quickly ascertain the nature of the technical disclosure. It is submitted with the understanding that neither will be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

Those skilled in the art will recognize that a wide variety of modifications, alterations, and combinations can be made with respect to the above described embodiments without departing from the spirit and scope of the invention and that such modifications, alterations, and combinations are to be viewed as being within the scope of the inventive concept. Thus, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims issuing from this application. The invention is defined solely by any claims issuing from this application and all equivalents of those issued claims.

The invention claimed is:

1. A multiband antenna structure comprising:

a raised base having a raised coaxial feed comprising an inner signal conductor and conductive coaxial shield surrounding the inner signal conductor;

a first radiating element extending from the base along a majority of the length of the antenna structure and having a first resonance, the first radiating element galvanically connected with the raised coaxial feed;

an impedance matching element, providing distributed impedance matching, comprising the conductive coaxial shield formed in the base, a base coil connecting the first radiating element with the raised coaxial feed, and a conductive sheath surrounding a portion of each of the conductive coaxial shield, the base coil, and the first radiating element; and a second electrically floating radiating element having a second resonance distinct from the first resonance;

wherein the conductive sheath has an opening through which the second electrically floating radiating element is capacitively coupled with the base coil in a radial direction of the antenna structure; and wherein the length of the antenna structure is less than about ¼ of the wavelength of a lowest operating frequency.

2. The antenna structure of claim 1, wherein the sheath is cylindrical and the first and second radiating elements are monopoles.

3. The antenna structure of claim 1, wherein the first radiating element is disposed between a third radiating element and the base coil in the direction of the length of the antenna structure.

4. The antenna structure of claim 3, wherein the first and third radiating elements are galvanically coupled.

5. The antenna structure of claim 3, wherein the first radiating element is a monopole and the third radiating element is helical.

6. The antenna structure of claim 1, wherein the distributed impedance matching is provided without the use of a separate integrated matching network.

7. The antenna structure of claim 1, wherein the first radiating element and the impedance matching element are disposed such that the combination provides adequate response in the ultra high frequency (UHF) band of about 380-540 MHz, the Public Safety band of about 700-800 MHz and the Global Positioning Satellite (GPS) band at about 1.575 GHz.

8. The antenna structure of claim 1, wherein the first and second radiating elements and the impedance matching element are disposed such that the combination of resonances provides continuous coverage over 120% of the bandwidth from UHF band at about 380 MHz up to about 1.2 GHz and an additional band of about 2 to 2.5 GHz.

9. The antenna structure of claim 1, wherein a length of the antenna structure is less than about 150 mm.

10. A multiband antenna comprising:

a wire monopole;

a radiating element coupled with the wire monopole and having a resonance higher than that of the wire monopole; and a distributed impedance matching element providing impedance matching over a predetermined frequency range of the antenna, comprising a conductive shield, a helical element galvanically connected to the wire monopole, and a sheath surrounding a portion of the shield and the helical element;

wherein the radiating element is capacitively coupled to the helical element through an opening in the sheath.

11. The antenna of claim 10, further comprising a helical radiating element, the wire monopole disposed between the helical radiating element and the helical element in the direction of the length of the antenna.

12. The antenna of claim 11, wherein the sheath is a semi-open cylindrical sheath surrounding a portion of the wire monopole.

13. The antenna of claim 10, wherein the wire monopole is disposed between the helical element and the radiating element in the direction of the length of the antenna.

14. The antenna of claim 13, wherein the radiating element is a helical element disposed at a distal end of the antenna.

* * * * *